US009077117B2

(12) United States Patent
Pao et al.

(10) Patent No.: US 9,077,117 B2
(45) Date of Patent: Jul. 7, 2015

(54) COMMUNICATION CONNECTING DEVICE AND LEAD FRAME ASSEMBLY THEREOF

(71) Applicant: TOPCONN ELECTRONIC (KUNSHAN) CO., LTD., Suzhou, Jiangsu Province (CN)

(72) Inventors: Chung-Nan Pao, New Taipei (TW); Xiaoyin Wang, Jiangsu (CN); Yu-Hsiung Lin, New Taipei (TW)

(73) Assignee: TOPCONN ELECTRONIC (KUNSHAN) CO., LTD., Suzhou, Jiangsu Province (CN)

( * ) Notice: Subject to any disclaimer, the term of this patent is extended or adjusted under 35 U.S.C. 154(b) by 4 days.

(21) Appl. No.: 14/083,562

(22) Filed: Nov. 19, 2013

(65) Prior Publication Data

US 2015/0079842 A1 Mar. 19, 2015

(30) Foreign Application Priority Data

Sep. 17, 2013 (CN) ..... 2013 1 0425991

(51) Int. Cl.
*H01R 13/514* (2006.01)
*H01R 13/648* (2006.01)

(52) U.S. Cl.
CPC ..... *H01R 13/648* (2013.01)

(58) Field of Classification Search
CPC ..... H01R 23/688; H01R 13/514; H01R 13/65807
See application file for complete search history.

(56) References Cited

U.S. PATENT DOCUMENTS

| | | | | |
|---|---|---|---|---|
| 5,135,405 | A * | 8/1992 | Fusselman et al. | 439/108 |
| 5,582,519 | A * | 12/1996 | Buchter | 439/101 |
| 6,409,543 | B1 * | 6/2002 | Astbury et al. | 439/607.07 |
| 8,444,435 | B2 * | 5/2013 | Lee et al. | 439/607.07 |
| 2002/0048995 | A1 * | 4/2002 | Shindo | 439/608 |
| 2003/0119362 | A1 * | 6/2003 | Nelson et al. | 439/608 |
| 2005/0032430 | A1 * | 2/2005 | Otsu et al. | 439/608 |
| 2007/0155241 | A1 * | 7/2007 | Lappohn | 439/608 |

* cited by examiner

*Primary Examiner* — Gary Paumen
(74) *Attorney, Agent, or Firm* — Li & Cai Intellectual Property (USA) Office

(57) ABSTRACT

A lead frame assembly includes two lead frames detachably coupled to each other. Each lead frame has an insulating frame, several signal terminals fixed on the insulating frame, and a ground terminal fixed on the insulating frame. One of the ground terminals has a shielding sheet and several groups of elastic arms, and the shielding sheet and the elastic arms are protruding from the corresponding insulating frame; another ground terminal has several shielding portions protruding from the corresponding insulating frame. The ground terminals are contact with each other along a shielding direction, and the groups of elastic arms are respectively abutted against the shielding portions. In a space, which is surroundingly defined by the contour of the shielding sheet extending along the shielding direction, the shielding direction passes through at least one of the shielding sheet, the elastic arms, and the shielding portions.

9 Claims, 12 Drawing Sheets

COMMUNICATION CONNECTING DEVICE AND LEAD FRAME ASSEMBLY THEREOF

BACKGROUND OF THE INVENTION

1. Field of the Invention

The instant disclosure relates to a connecting device; more particularly, to a communication connecting device and a lead frame assembly thereof for transmitting high frequency signal.

2. Description of Related Art

The conventional communication connecting device includes two communication connectors coupled with each other, and each communication connector has a plurality of grounding terminals and a plurality of signal terminals. When the communication connectors are coupled with each other along an inserting direction, the signal terminals of the conventional communication connectors are contact with each other for transmitting signal, and the grounding terminals of the conventional communication connectors are used for providing shielding effect, thereby preventing the signal transmission from interference.

However, the adjacent portions of the grounding terminals of the conventional communication connectors can't provide entirely shielding. For example, when observing the coupled conventional communication connectors along a shielding direction perpendicular to the inserting direction, a gap is existed at the adjacent portions of the grounding terminals, such that the shielding direction can pass through the gap without pass any grounding terminal. Specifically, the grounding terminals do not provide any shielding at the position of gap in the shielding direction, so that the shielding effect provided from the grounding terminals is not enough.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides a communication connecting device and a lead frame assembly thereof, which capable of better shielding effect by the structural design of two mating grounding terminals.

The communication connecting device in the instant disclosure comprises: a first communication connector having a plurality of first lead frames stacked in one row, and each first lead frame comprising: a first insulating frame; a plurality of first signal terminals installed on the first insulating frame; and a first grounding terminal disposed on the first insulating frame, the first grounding terminal having a first shielding sheet and a plurality of groups of elastic arms integrally extended from the first shielding sheet, and the first shielding sheet and the elastic arms protruding out of the first insulating frame, wherein a contour of the first shielding sheet has an top edge, a bottom edge, and an end edge connecting the top and bottom edges, and wherein the first shielding sheet has a plurality of groups of notches arranged inside the contour thereof, and the elastic arms are respectively extended toward the notches; and a second communication connector having a plurality of second lead frames stacked in one row, and each second lead frame comprising: a second insulating frame; a plurality of second signal terminals installed on the second insulating frame; and a second grounding terminal disposed on the second insulating frame and having a second shielding sheet, the second shielding sheet protruding out of the second insulating frame and having a plurality of shielding portions, wherein the first communication connector is detachably coupled to the second communication connector along an inserting direction, and the first lead frames are respectively coupled to the second lead frames, wherein at each pair of coupled first and second lead frames, the first signal terminals respectively contact the second signal terminals, and the groups of elastic arms respectively contact the shielding portions in a shielding direction perpendicular to the inserting direction, and wherein one side of the contact portions of the coupled first and second signal terminals is shielded by the first shielding sheet, the elastic arms, and the shielding portions, and an area arranged between the top and bottom edges of the first shielding sheet extends along the shielding direction to define a covering space, the shielding direction passes through at least one of the first shielding sheet, the elastic arms, and the shielding portions in the covering space.

The lead frame assembly of the communication connecting device comprises: a first lead frame comprising: a first insulating frame; a plurality of first signal terminals installed on the first insulating frame; and a first grounding terminal disposed on the first insulating frame, the first grounding terminal having a first shielding sheet and a plurality of groups of elastic arms integrally extended from the first shielding sheet, and the first shielding sheet and the elastic arms protruding out of the first insulating frame, wherein a contour of the first shielding sheet has an top edge, a bottom edge, and an end edge connecting the top and bottom edges, and wherein the first shielding sheet has a plurality of groups of notches arranged inside the contour thereof, and the elastic arms are respectively extended toward the notches; and a second lead frame comprising: a second insulating frame; a plurality of second signal terminals installed on the second insulating frame; and a second grounding terminal disposed on the second insulating frame and having a second shielding sheet, the second shielding sheet protruding out of the second insulating frame and having a plurality of shielding portions, wherein the first lead frame is detachably coupled to the second lead frame along an inserting direction, the first signal terminals respectively contact the second signal terminals, and the groups of elastic arms respectively contact the shielding portions in a shielding direction perpendicular to the inserting direction, and wherein one side of the contact portions of the coupled first and second signal terminals is shielded by the first shielding sheet, the elastic arms, and the shielding portions, and an area arranged between the top and bottom edges of the first shielding sheet extends along the shielding direction to define a covering space, the shielding direction passes through at least one of the first shielding sheet, the elastic arms, and the shielding portions in the covering space.

In summary, the communication connecting device and the lead frame assembly thereof are provided to reduce the signal transmission of the first and second signal terminals from interference by the first shielding sheet, the elastic arms, and the shielding portions entirely shielding one side of the mating portions of the first and second signal terminals.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
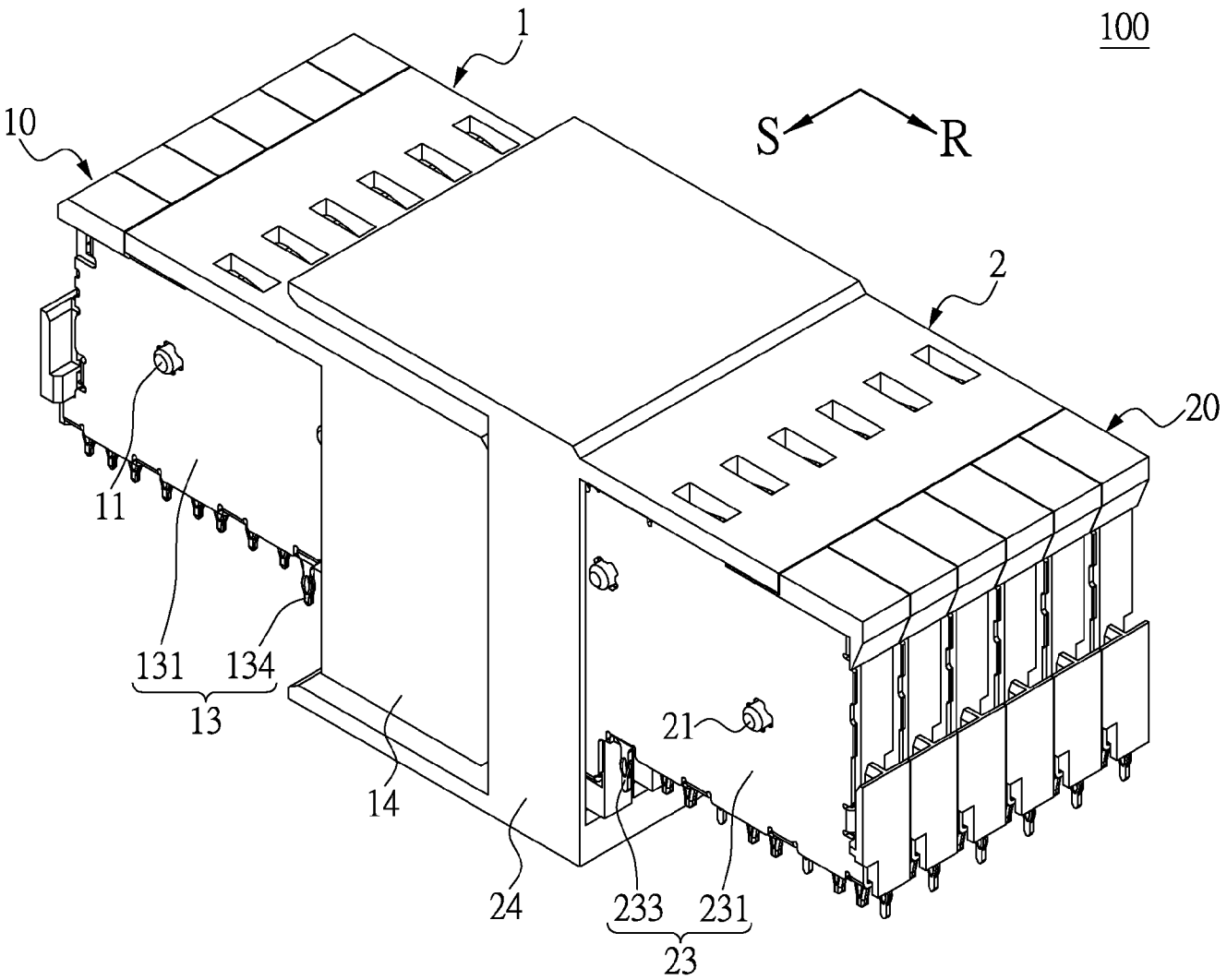
FIG. 1 is a perspective view of a communication connecting device according to the instant disclosure.
Figure 2:
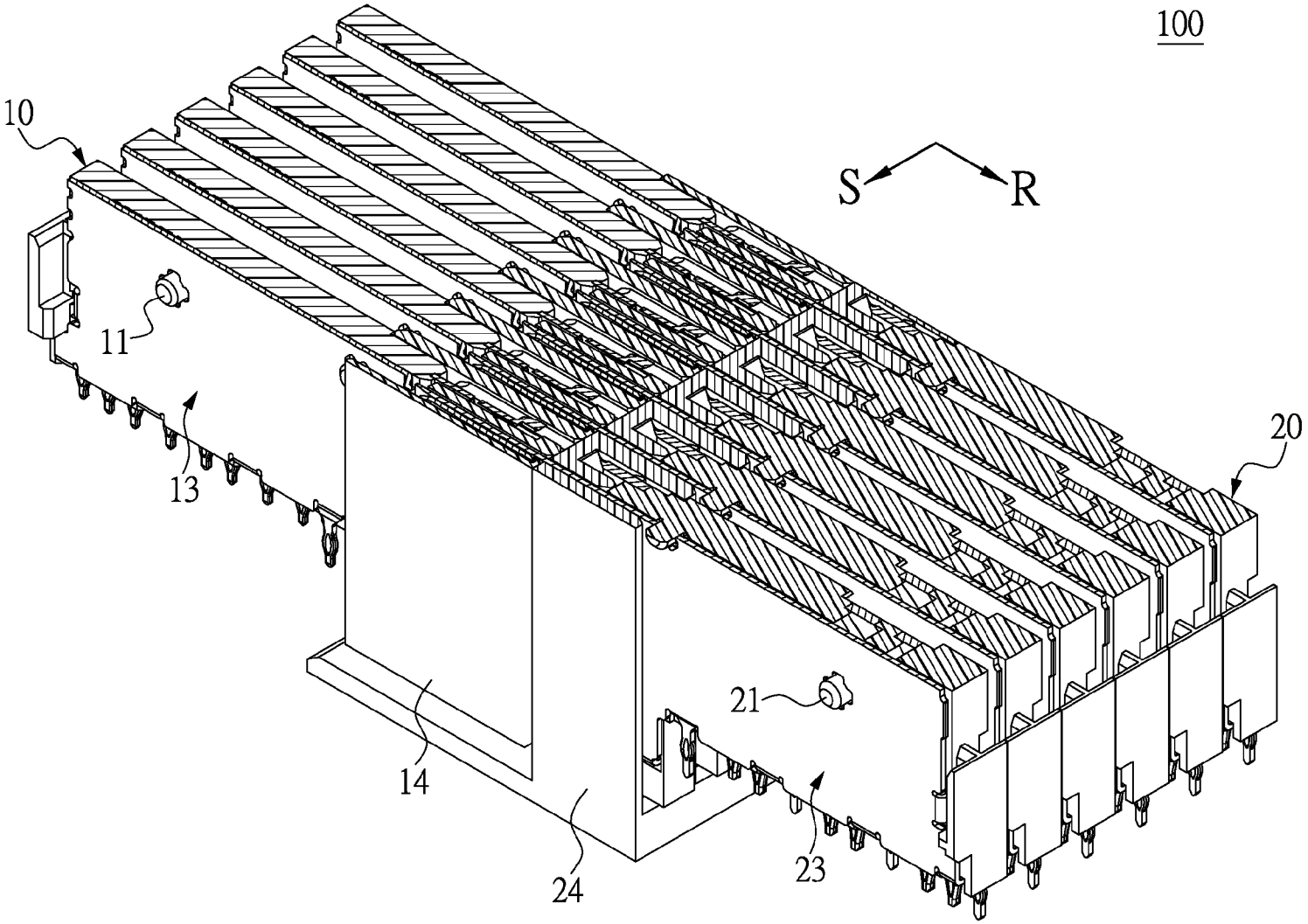
FIG. 2 is a cross-sectional view of FIG. 1 according to the instant disclosure.
Figure 3:
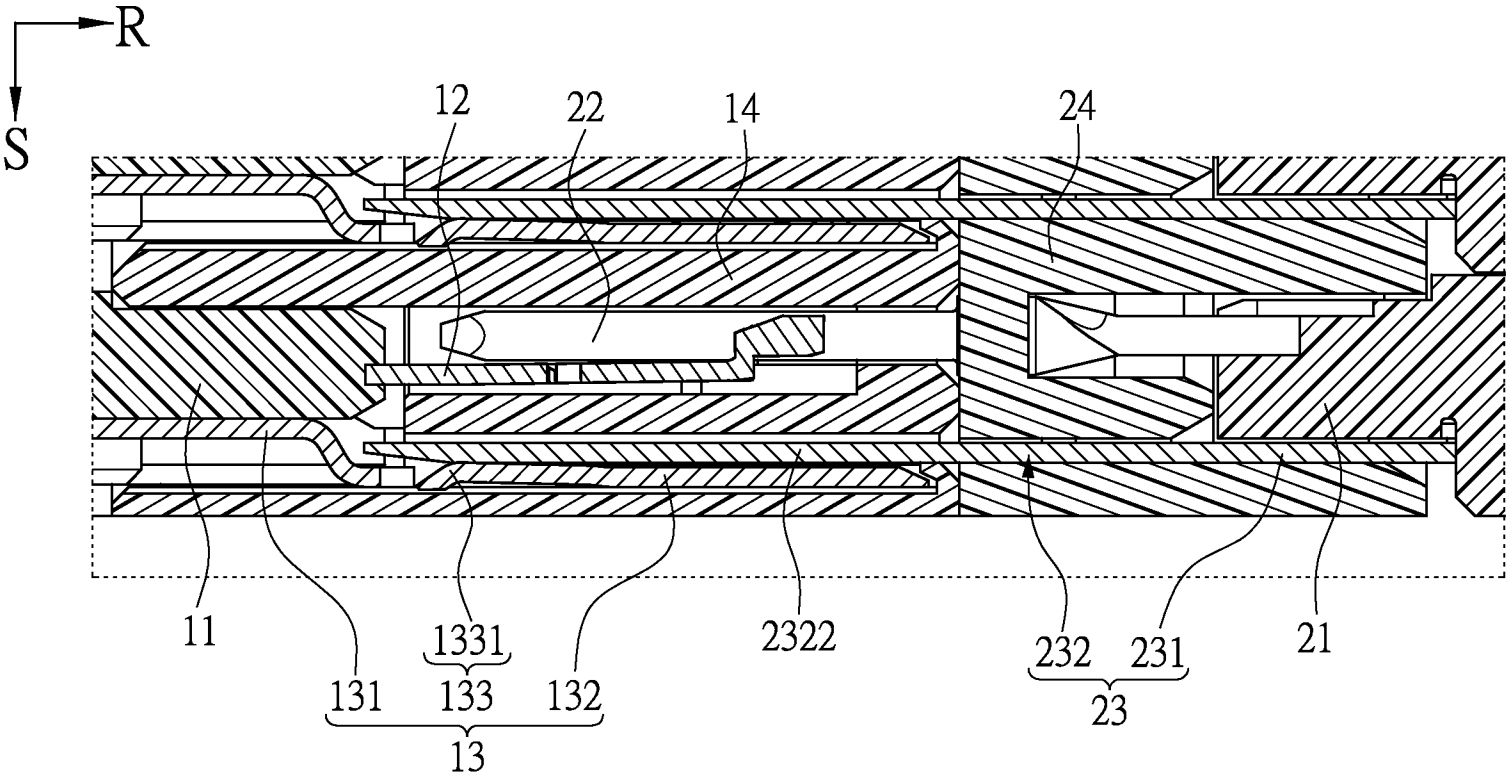
FIG. 3 is an enlarger view of FIG. 2 according to the instant disclosure.

Please refer to FIGS. 1 through 3, which show an embodiment of the instant disclosure. References are hereunder made to the detailed descriptions and appended drawings in connection with the instant disclosure. However, the appended drawings are merely shown for exemplary purposes, rather than being used to restrict the scope of the instant disclosure.

The instant embodiment discloses a communication connecting device 100 including a first communication connector 1 and a second communication connector 2 detachably inserting into the first communication connector 1 along an inserting direction R. The following description discloses the structural features of the first communication connector 1 and the second communication connector 2 firstly, and then discloses the relative features of the first communication connector 1 and the second communication connector 2.

Figure 4:
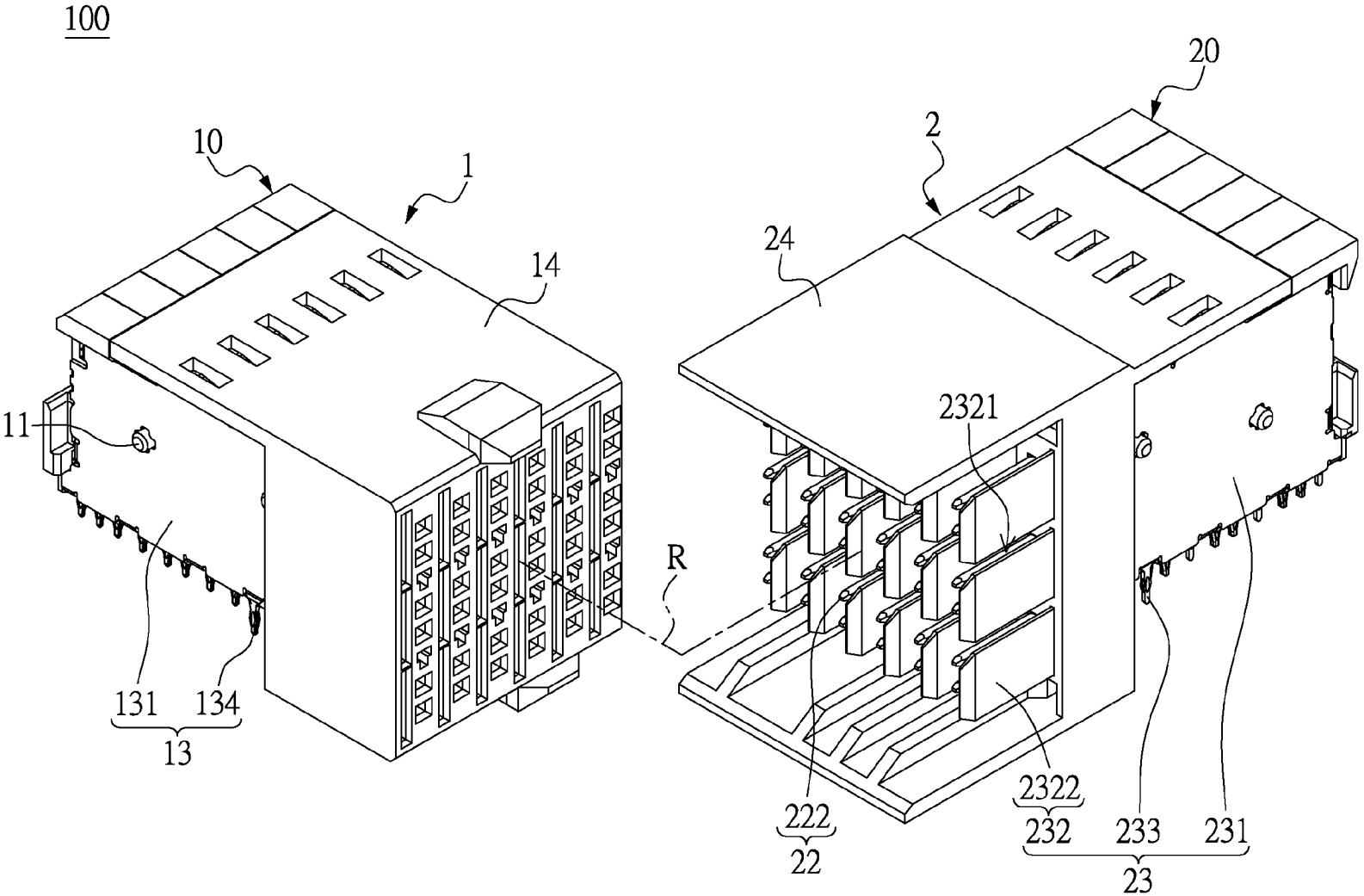
FIG. 4 is an exploded view of the communication connecting device according to the instant disclosure.
Figure 5:
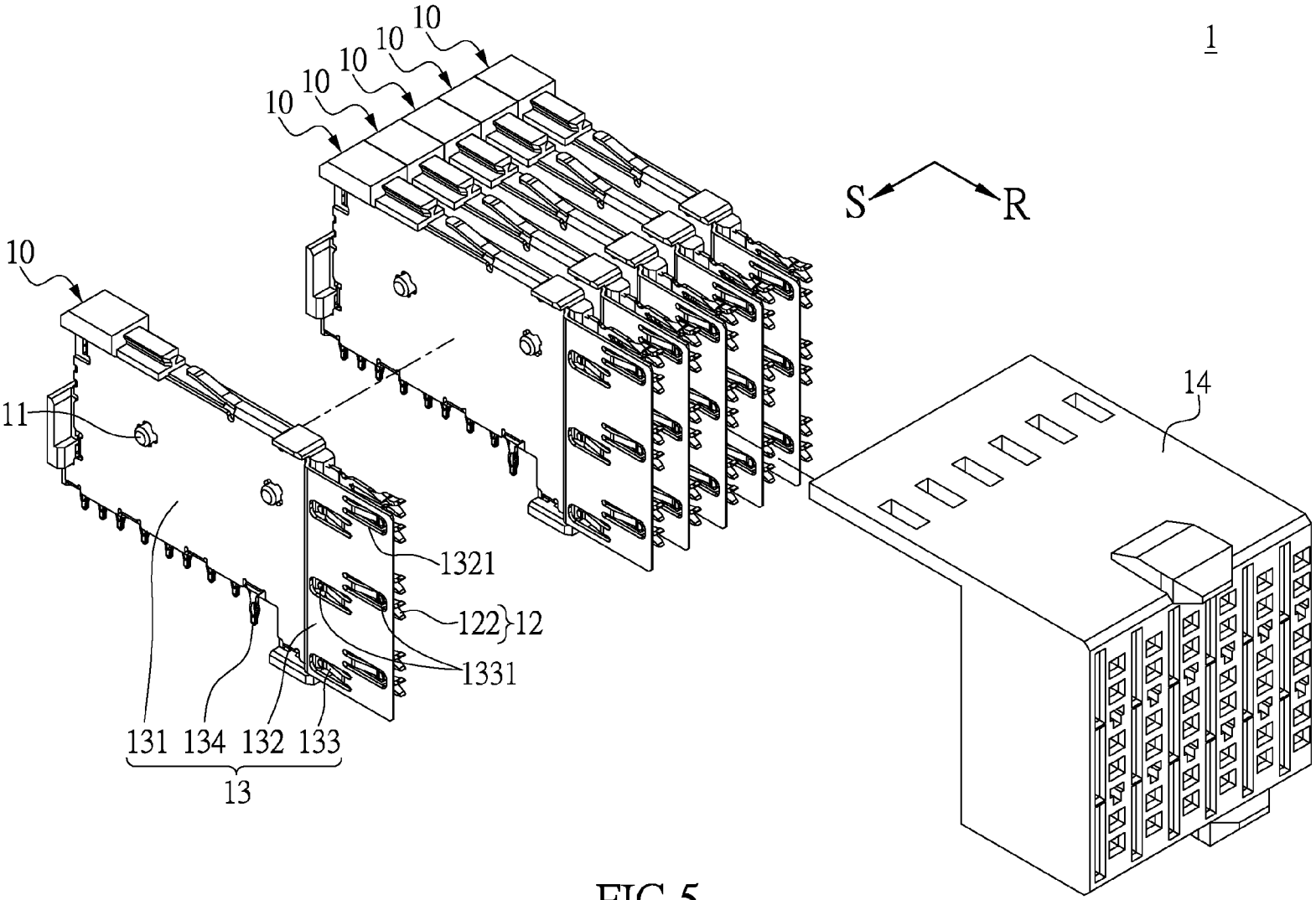
FIG. 5 is an exploded view of the first communication connector of FIG. 4 according to the instant disclosure.

Please refer to FIGS. 4 and 5. The first communication connector 1 includes a plurality of first lead frames 10 and a first outer casing 14. The first lead frames 10 are stacked in one row, and the first outer casing 14 is sleeved at one end portion of each first lead frame 10 (i.e., the right end portion of each first lead frame 10 as shown in FIG. 4) for maintaining the relative position of the first lead frames 10. The structures of first lead frames 10 are approximately identical, so that the following description only takes one of the first lead frames 10 for stating its structure.

Figure 6:
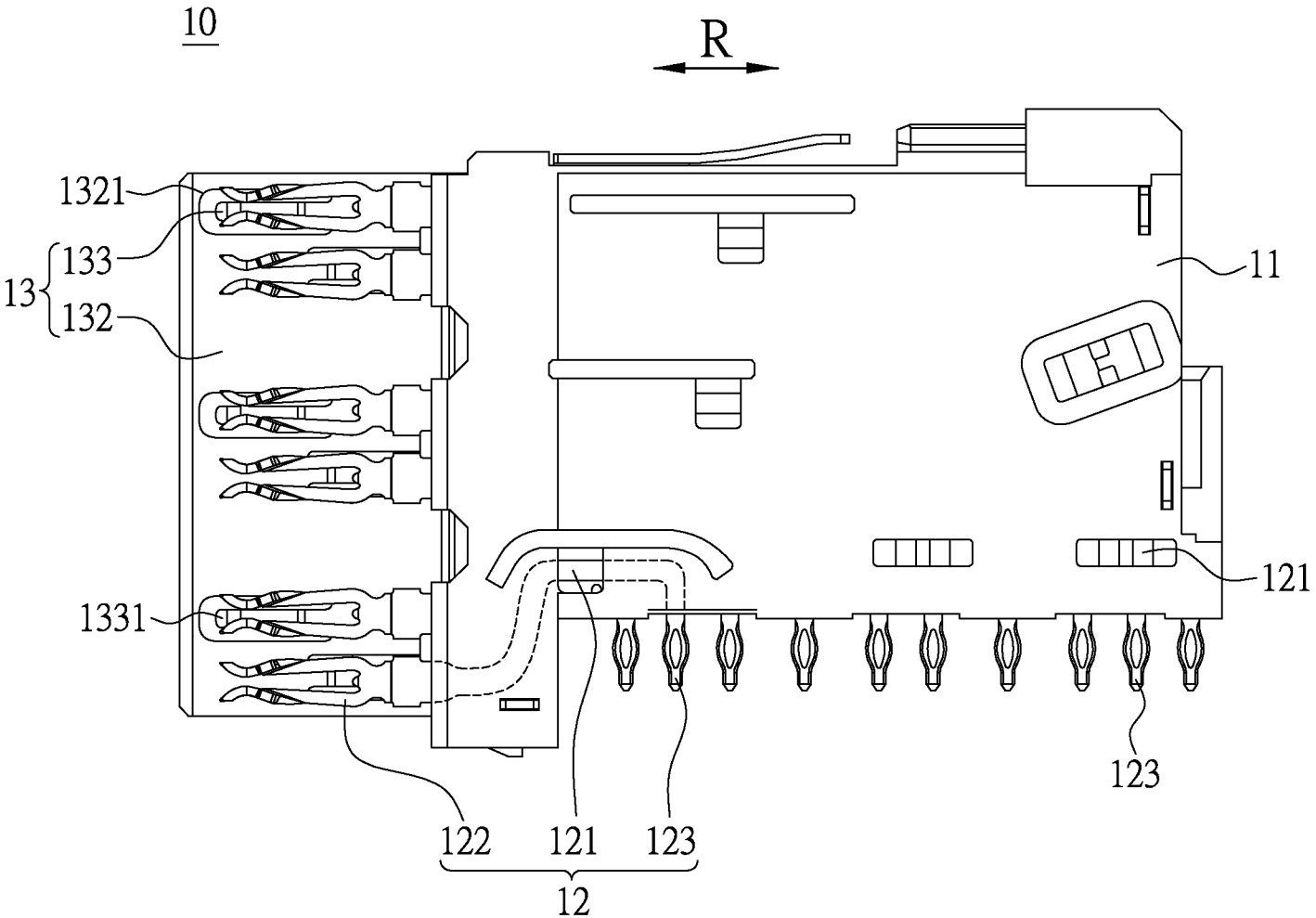
FIG. 6 is a perspective view of the first lead frame of FIG. 5 according to the instant disclosure.

Please refer to FIGS. 5 and 6. The first lead frame 10 includes a substantially platy first insulating frame 11, a plurality of elongated first signal terminals 12, and a substantially platy first grounding terminal 13. The first signal terminals 12 and the first grounding terminal 13 are installed on the first insulating frame 11, and the first signal terminals 12 in the instant embodiment are defined as a plurality of first differential pairs for example, but the instant disclosure is not limited thereto.

The first signal terminals 12 are embedded in the first insulating frame 11 and in approximately coplanar arrangement by insert molding. Two adjacent first signal terminals 12, which are respectively belong to different and adjacent pairs of the first signal terminals 12, have an interval therebetween (i.e., the shortest distance between one pair of the first signal terminals 12 and the adjacent pair of the first signal terminals 12), and the interval is larger than a gap of two adjacent first signal terminals 12 belong to the same pair of the first signal terminals 12. Each first signal terminal 12 has an embedded portion 121, a mating portion 122, and a positioning portion 123. The embedded portion 121 of each first signal terminal 12 is fixedly embedded in the first insulating frame 11, and the mating portion 122 and the positioning portion 123 are respectively and integrally extended from two opposite ends of the corresponding embedded portion 121 (i.e., the left and right ends of the embedded portion 121 as shown in FIG. 6).

Specifically, at each first lead frame 10, two opposite end portions of each first signal terminal 12 (i.e., the left end portion and the right end portion of the first signal terminal 12 as shown in FIG. 6) are respectively the mating portion 122 and the positioning portion 123, and the mating portion 122 and the positioning portion 123 are protruding out of the first insulating frame 11. Each mating portion 122 extends from the embedded portion 121 along an extending direction, which is parallel to the inserting direction R. Each positioning portion 123 extends from the embedded portion 121 along an extending direction, which is perpendicular to the extending direction of the corresponding mating portion 122.

The first grounding terminal 13 is installed on (i.e., wedged to) one side surface of the first insulating frame 11 (i.e., the left side surface of the first insulating frame 11 as shown in FIG. 5), and the surface of the first grounding terminal 13 away from the corresponding first signal terminal 12 is exposed from the first insulating frame 11. The first grounding terminal 13 has a first main body 131, a first shielding sheet 132, a plurality of groups of elastic arms 133 punched from the first shielding sheet 132, and a plurality of first pins 134.

The contour of the first main body 131 approximately conforms to the side surface of the first insulating frame 11, and the first main body 131 is disposed on the side surface of the first insulating frame 11. The first shielding sheet 132 and the first pins 134 are respectively and integrally extended from two opposite ends of the first main body 131 (i.e., the right end and the bottom end of the first main body 131 as shown in FIG. 5). The first shielding sheet 132 extends from the first main body 131 along an extending direction, which is parallel to the inserting direction R. Each first pin 134 extends from the first main body 131 along an extending direction, which is perpendicular to the extending direction of the corresponding first shielding sheet 132.

Moreover, a contour of the first shielding sheet 132 has an top edge, a bottom edge, and an end edge (i.e., the right end edge of the first shielding sheet 132 as shown in FIG. 5) connecting the top and bottom edges. The end edge of the first shielding sheet 132 is a continuous straight and arranged away from the first insulating frame 11. The first shielding sheet 132 has a plurality of groups of notches 1321 arranged inside the contour thereof, and the notches are located between the end edge of the first shielding sheet 132 and the main body 131. The elastic arms 133 are respectively and integrally extended from the inner walls of the first shielding sheet 132, which are respectively defines the notches 1321, toward the notches 1321. The first shielding sheet 132 and the elastic arms 133 are protruding out of the first insulating frame 11.

Specifically, each group of elastic arms 133 includes two elastic arms 133, and each group of notches 1321 includes two notches 1321. The two elastic arms 133 of each group are respectively extended from the first shielding sheet 132 along two opposite directions, which are away from to each other.

The elastic arms 133 are respectively aligning the mating portions 122 of the corresponding signal terminals 12 in a shielding direction S, which is approximately perpendicular to the inserting direction R. The shielding direction S is substantially parallel to the stacked direction of the first lead frames 10.

The longitudinal direction of each elastic arm 133 is substantially parallel to the inserting direction R, and a gap is existed between the two elastic arms 133 of each group. Each elastic arm 133 has a contact portion 1331 formed by bending toward the mating portion 122 of the corresponding first signal terminal 12, and the contact portion 1331 is approximately arranged at the end part of elastic arm 133 and operated as a free end, which is capable of resiliently swing.

Moreover, the contact portions 1331 of each group of elastic arms 133 are respectively arranged at front and rear positions in reference to the inserting direction R. That is to say, one contact portion 1331 of each group of elastic arms 133 is aligning the front end of the mating portion 122 of the corresponding first signal terminal 12, and another contact portion 1331 is aligning the rear end of the mating portion 122 of the corresponding first signal terminal 12.

Figure 7:
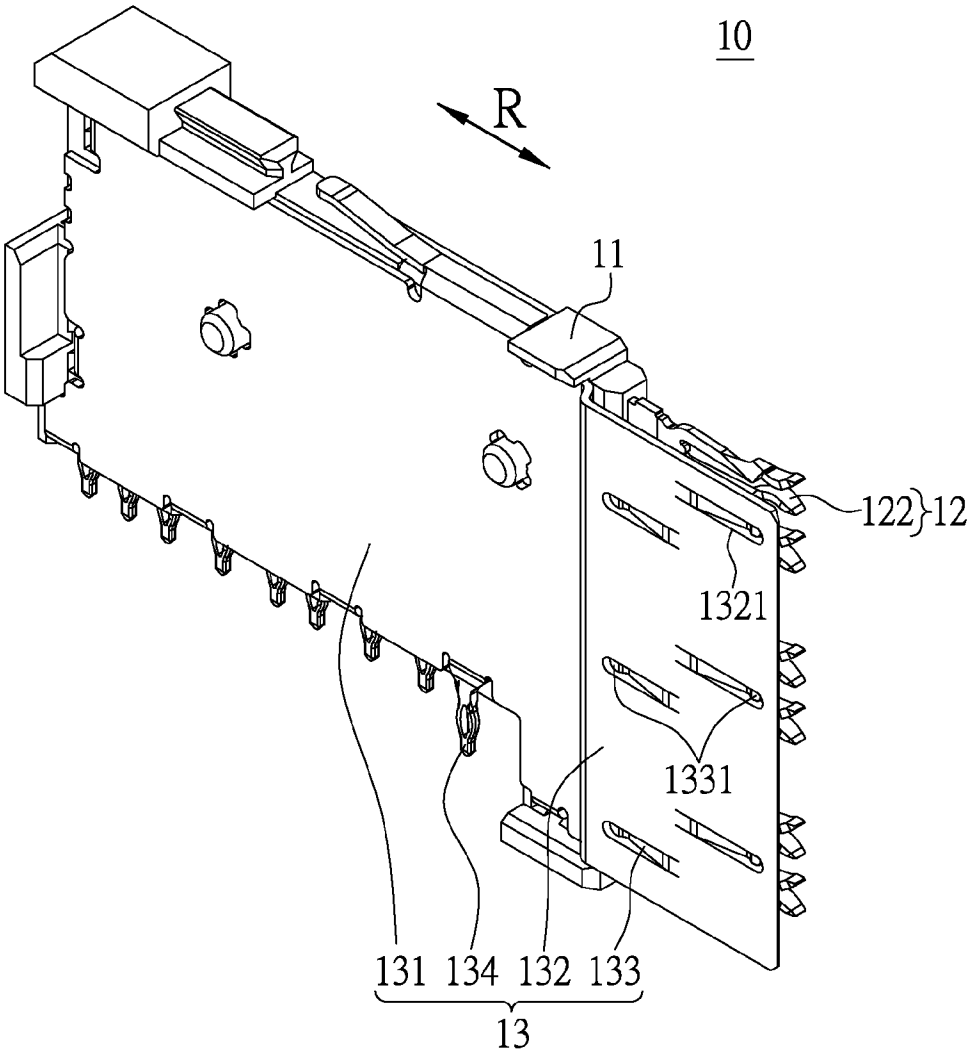
FIG. 7 is a perspective view of the first lead frame in another type according to the instant disclosure.
Figure 8:
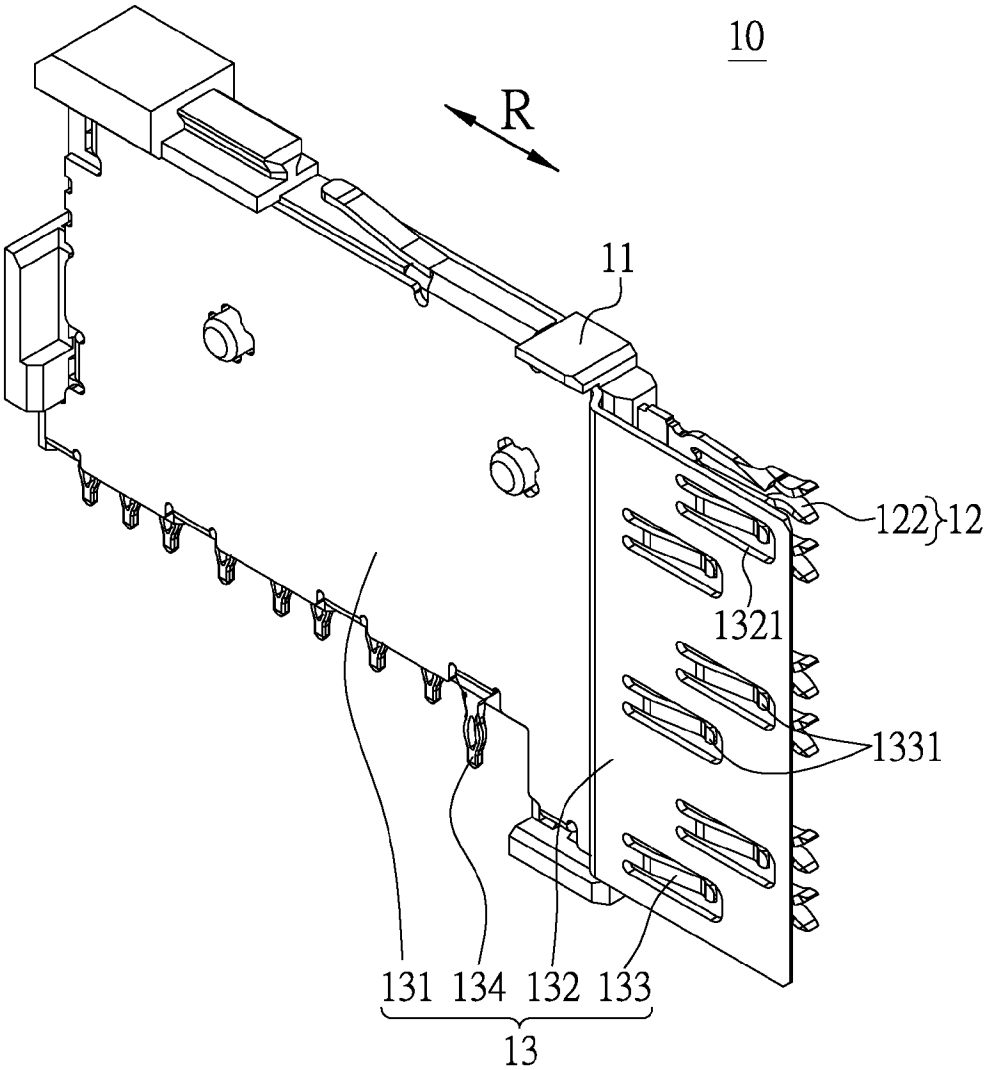
FIG. 8 is a perspective view of the first lead frame in still another type according to the instant disclosure.

Besides, each notch 1321 and the corresponding elastic arm 133 in the instant embodiment jointly define an U-shaped hole as shown in FIG. 5, but the instant disclosure is not limited thereto. For example, please refer to FIG. 7, which shows each elastic arm 133 is substantially filling full of the corresponding notch 1321. Moreover, the two elastic arms 133 of each group in the instant embodiment are respectively extended from the first shielding sheet 132 along two opposite directions as shown in FIG. 5, but the instant disclosure is not limited thereto. For example, please refer to FIG. 8, which shows the two elastic arms 133 of each group in the instant embodiment are extended from the first shielding sheet 132 along the same direction.

Please refer to FIGS. 2 and 3. The first outer casing 14 is sleeved at one end portions of the first lead frames 10, and the first outer casing 14 is assembled with the first insulating frames 11. The mating portion 122 of each signal terminal 12 and the first shielding sheet 132 and the elastic arms 133 of each first grounding terminal 13 are received in the first outer casing 14.

Figure 9:
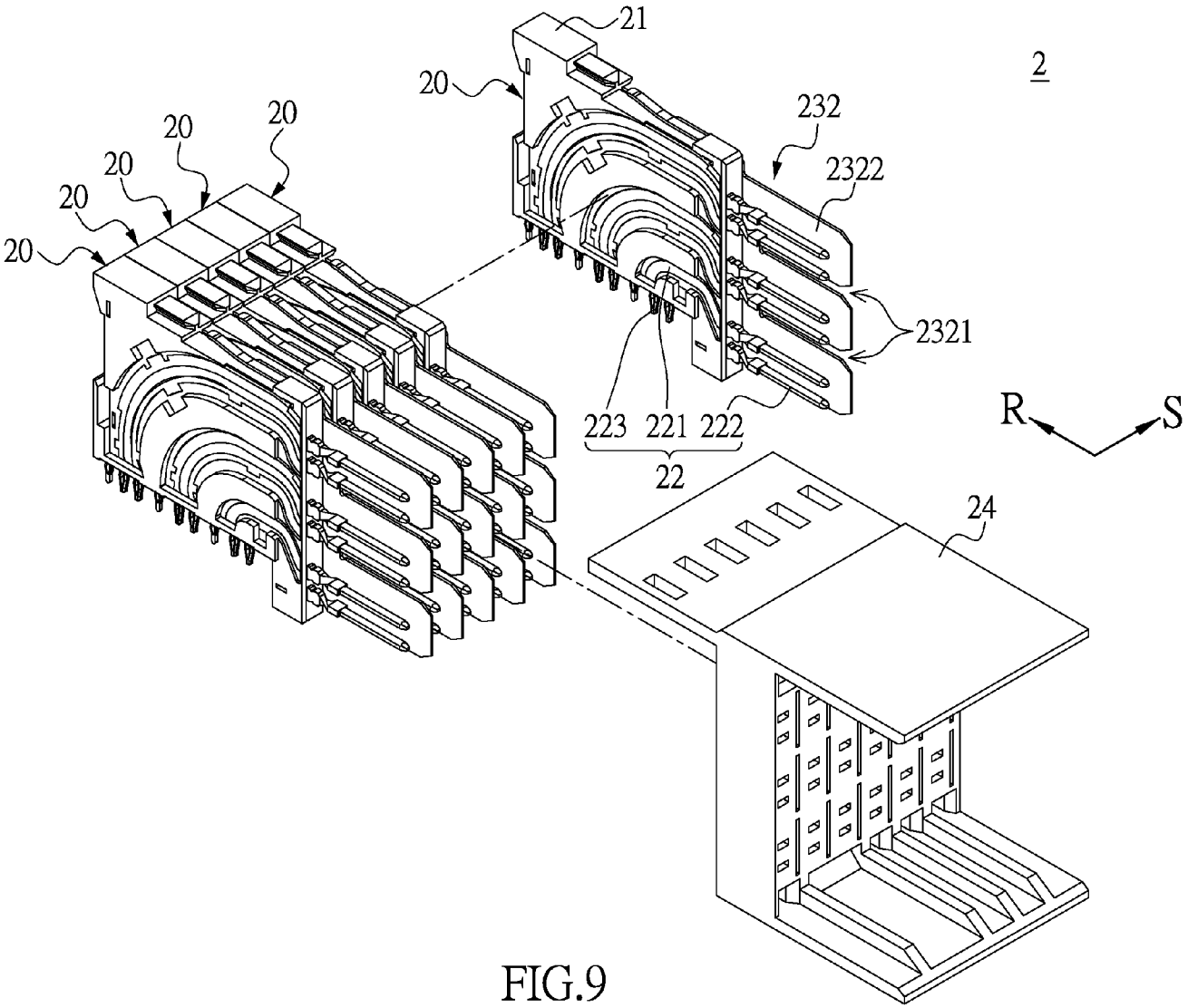
FIG. 9 is an exploded view of the second communication connector of FIG. 4 according to the instant disclosure.

Please refer to FIG. 9. The second communication connector 2 includes a plurality of second lead frames 20 and a second outer casing 24. The second lead frames 20 are stacked in one row, and the second outer casing 24 is sleeved at one end portion of each second lead frame 20 (i.e., the right end portion of each second lead frame 20 as shown in FIG. 9) for maintaining the relative position of the second lead frames 20. The structures of second lead frames 20 are approximately identical, so that the following description only takes one of the second lead frames 20 for stating its structure.

Figure 10:
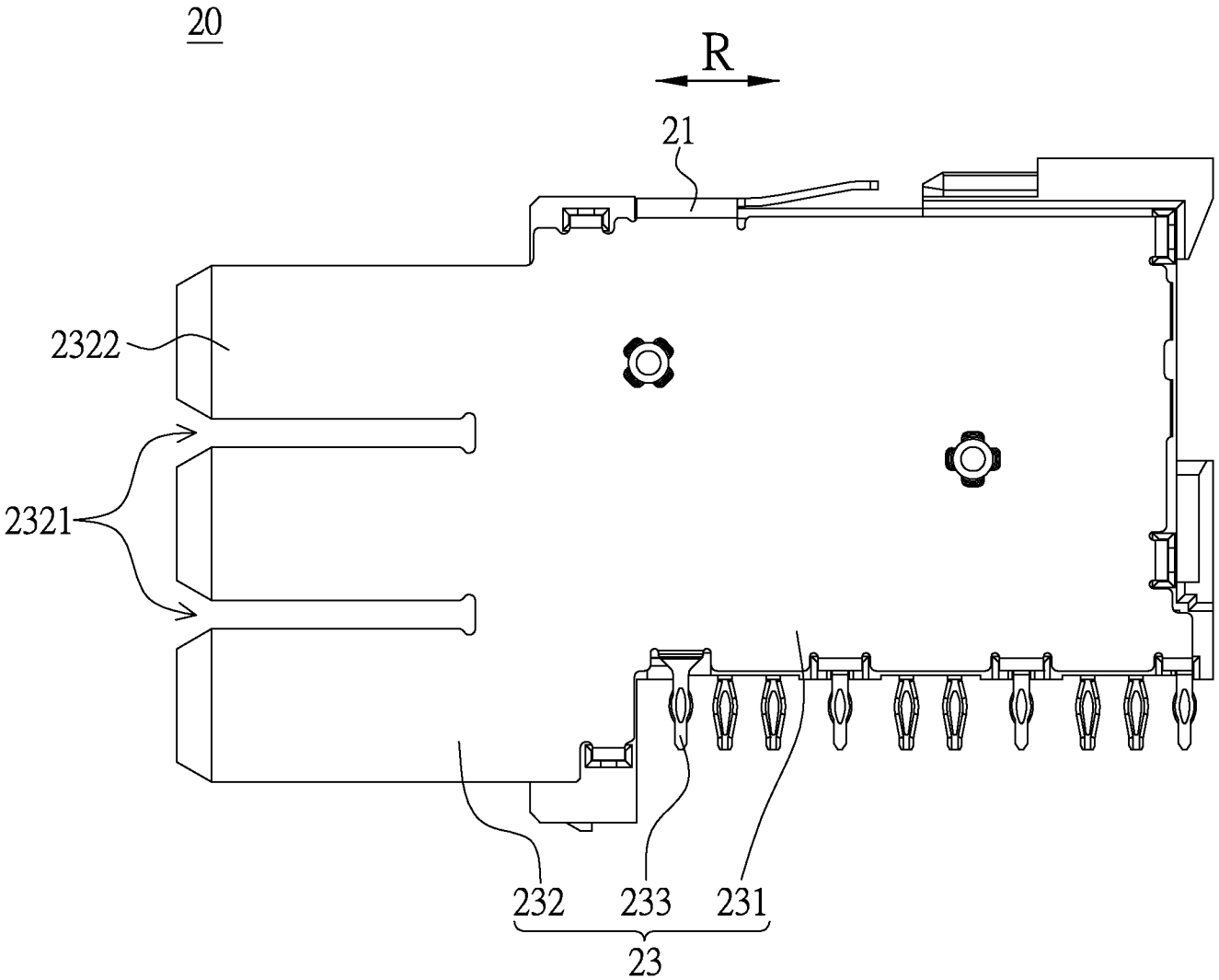
FIG. 10 is a perspective view of the second lead frame of FIG. 9 according to the instant disclosure.

Please refer to FIGS. 9 and 10. The second lead frame 20 includes a substantially platy second insulating frame 21, a plurality of elongated second signal terminals 22, and a substantially platy second grounding terminal 23. The second t signal terminals 22 and the second grounding terminal 23 are installed on the second insulating frame 21, and the second signal terminals 22 in the instant embodiment are defined as a plurality of second differential pairs for example, but the instant disclosure is not limited thereto.

The second signal terminals 22 are embedded in the second insulating frame 21 and in approximately coplanar arrangement by insert molding. Two adjacent second signal terminals 22, which are respectively belong to different and adjacent pairs of the second signal terminals 22, have an interval there-between (i.e., the shortest distance between one pair of the second signal terminals 22 and the adjacent pair of the second signal terminals 12), and the interval is larger than a gap of two adjacent second signal terminals 22 belong to the same pair of the second signal terminals 22. Each second signal terminal 22 has an embedded portion 221, a mating portion 222, and a positioning portion 223. The embedded portion 221 of each second signal terminal 22 is fixedly embedded in the second insulating frame 21, and the mating portion 222 and the positioning portion 223 are respectively and integrally extended from two opposite ends of the corresponding embedded portion 221 (i.e., the right and left ends of the embedded portion 221 as shown in FIG. 9).

Specifically, at each second lead frame 20, two opposite end portions of each second signal terminal 22 (i.e., the right end portion and the left end portion of the second signal terminal 22 as shown in FIG. 9) are respectively the mating portion 222 and the positioning portion 223, and the mating portion 222 and the positioning portion 223 are protruding out of the second insulating frame 21. Each mating portion 222 extends from the embedded portion 221 along an extending direction, which is parallel to the inserting direction R. Each positioning portion 223 extends from the embedded portion 221 along an extending direction, which is perpendicular to the extending direction of the corresponding mating portion 222.

The second grounding terminal 23 is installed on (i.e., wedged to) one side surface of the second insulating frame 21 (i.e., the right side surface of the second insulating frame 21 as shown in FIG. 9), and the surface of the second grounding terminal 23 away from the corresponding second signal terminal 22 is exposed from the second insulating frame 21. The second grounding terminal 23 has a second main body 231, a second shielding sheet 232, and a plurality of second pins 233.

The contour of the second main body 231 approximately conforms to the side surface of the second insulating frame 21, and the second main body 231 is disposed on the side surface of the second insulating frame 21. The second shielding sheet 232 and the second pins 233 are respectively and integrally extended from two opposite ends of the second main body 231 (i.e., the left end and the bottom end of the second main body 231 as shown in FIG. 10). The second shielding sheet 232 extends from the second main body 231 along an extending direction, which is parallel to the inserting direction R. Each second pin 233 extends from the second main body 231 along an extending direction, which is perpendicular to the extending direction of the corresponding second shielding sheet 232.

The second shielding sheet 232 is protruding out of the second insulating frame 21, and the second shielding sheet 232 has a plurality of separating troughs 2321 concaving from an end edge thereof away from the second insulating frame 21 (i.e., the left end edge of the second shielding sheet 232 as shown in FIG. 10) toward the second insulating frame 21. The second shielding sheet 232 is divided into a plurality of elongated strips by the separating troughs 2321, and one portion of each elongated strip away from the second insulating frame 21 (i.e., the left portion of the second shielding sheet 232 as shown in FIG. 10) is defined as a shielding portion 2322. Specifically, the length of each shielding portion 2322 with respect to the inserting direction R is substantially identical to the length of the first shielding sheet 132 with respect to the inserting direction R.

Please refer to FIGS. 2 and 3. The second outer casing 24 is sleeved at one end portions of the second lead frames 20, and the second outer casing 24 is assembled with the second insulating frames 21. Each second grounding terminal 23 only exposes the shielding portions 232 thereof to the second outer casing 24, and a portion of each separating trough 2321 adjacent to the second insulating frame 21 is embedded in the second outer casing 24.

The above description discloses the structural features of the first communication connector 1 and the second communication connector 2, and the following description continuously discloses the relative features of the first communication connector 1 and the second communication connector 2.

Please refer to FIGS. 2 and 3. The first communication connector 1 is assembled to the second communication connector 2 along the inserting direction R, in which the first outer casing 14 is assembled to the second outer casing 24 and the first lead frames 10 are respectively assembled to the second lead frames 20. Specifically, at each pair of assembled first and second lead frames 10, 20, the mating portions 122 of the first signal terminals 12 respectively contact the mating portions 222 of the second signal terminals 22, the first shielding sheet 132 of the first grounding terminal 13 is parallel to the second shielding sheet 232 of the second grounding terminal 23, the first and second shielding sheets 132, 232 are respectively perpendicular to the shielding direction S, and the groups of elastic arms 133 respectively contact the shielding portions 2322 in the shielding direction S.

Moreover, one side of the mating portions 122, 222 of the first and second signal terminals 12, 22 is entirely shielded by the first shielding sheet 132, the elastic arms 133, and the shielding portions 2322. Specifically, an area arranged between the top and bottom edges of the first shielding sheet 132 extends along the shielding direction S to define a covering space, and the shielding direction S passes through at least one of the first shielding sheet 132, the elastic arms 133, and the shielding portions 2322 in the covering space.

Incidentally, the area arranged between the top and bottom edges of the first shielding sheet 132 is a convex polygon, not a concave polygon. Moreover, the top and bottom edges of the first shielding sheet 132 in the instant embodiment are straight-like, so that the area arranged between the top and bottom edges of the first shielding sheet 132 is substantially a quadrangle (i.e., rectangle). That is to say, two opposite ends of the top edge are respectively connecting two opposite ends of the bottom edge by two non-crossed straight lines, and the straight lines and the top and bottom edges of the first shielding sheet 132 are jointly surrounding to define the four edges of the area. Moreover, the contour of the area in the instant embodiment is approximately identical to the contour of the first shielding sheet 132, but the instant disclosure is not limited thereto.

Figure 11:
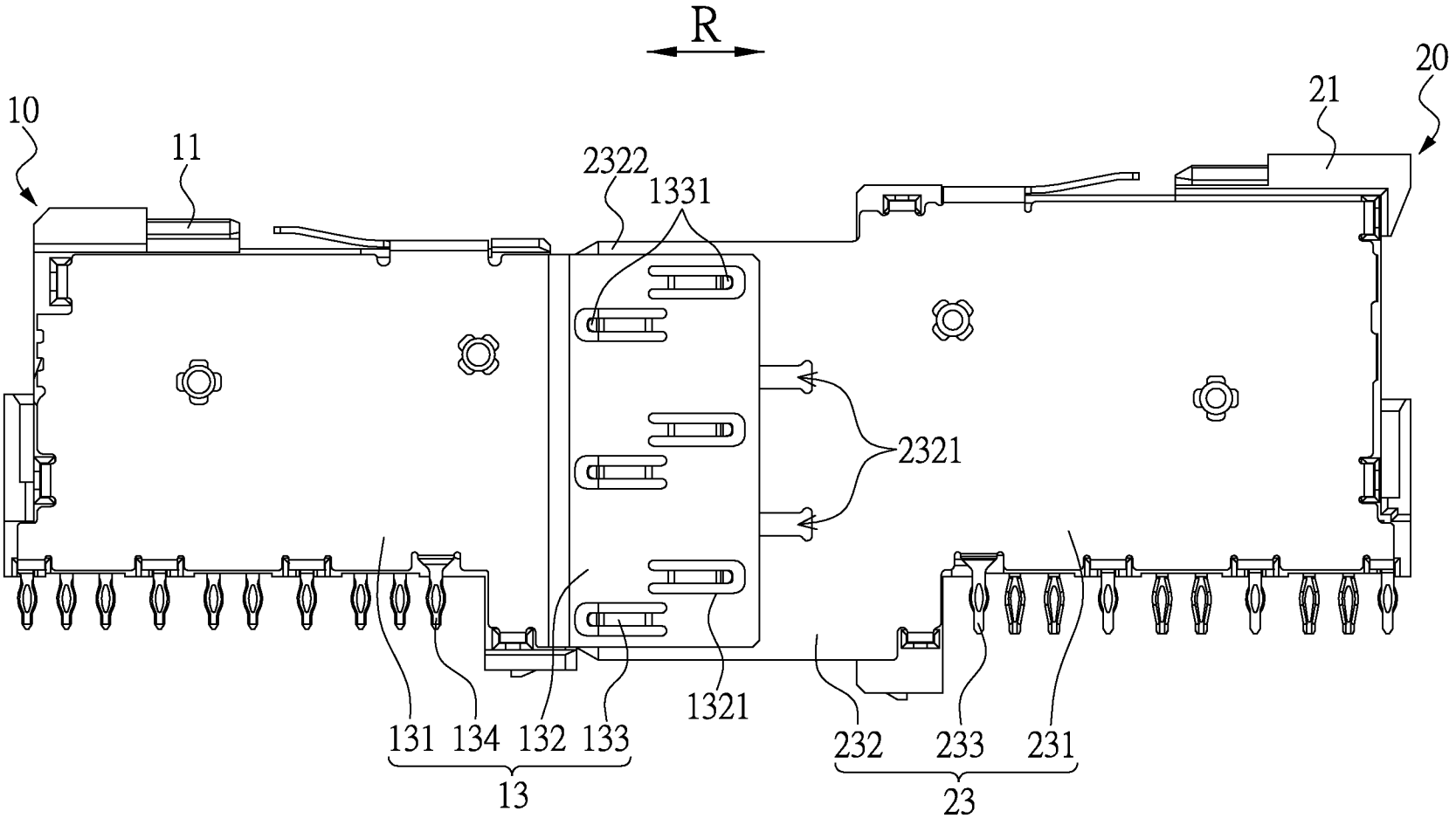
FIG. 11 is a perspective view of the assembled first and second lead frames according to the instant disclosure.

On the other hands, when observing the pair of assembled first and second lead frames 10, 20 along the shielding direction S as shown in FIG. 11, the first shielding sheet 132, the elastic arms 133, and the shielding portions 2322 can be seen, and the mating portions 122, 222 of the first and second signal terminals 12, 22 can't be seen. The first shielding sheet 132 covers the un-embedded portion of each separating trough 2321, and the second sheet 232 covers the space, which is defined by each notch 1321. Incidentally, the un-covered portion of each separating trough 2321 as shown in FIG. 11 is embedded in the second outer casing 24.

Figure 12:
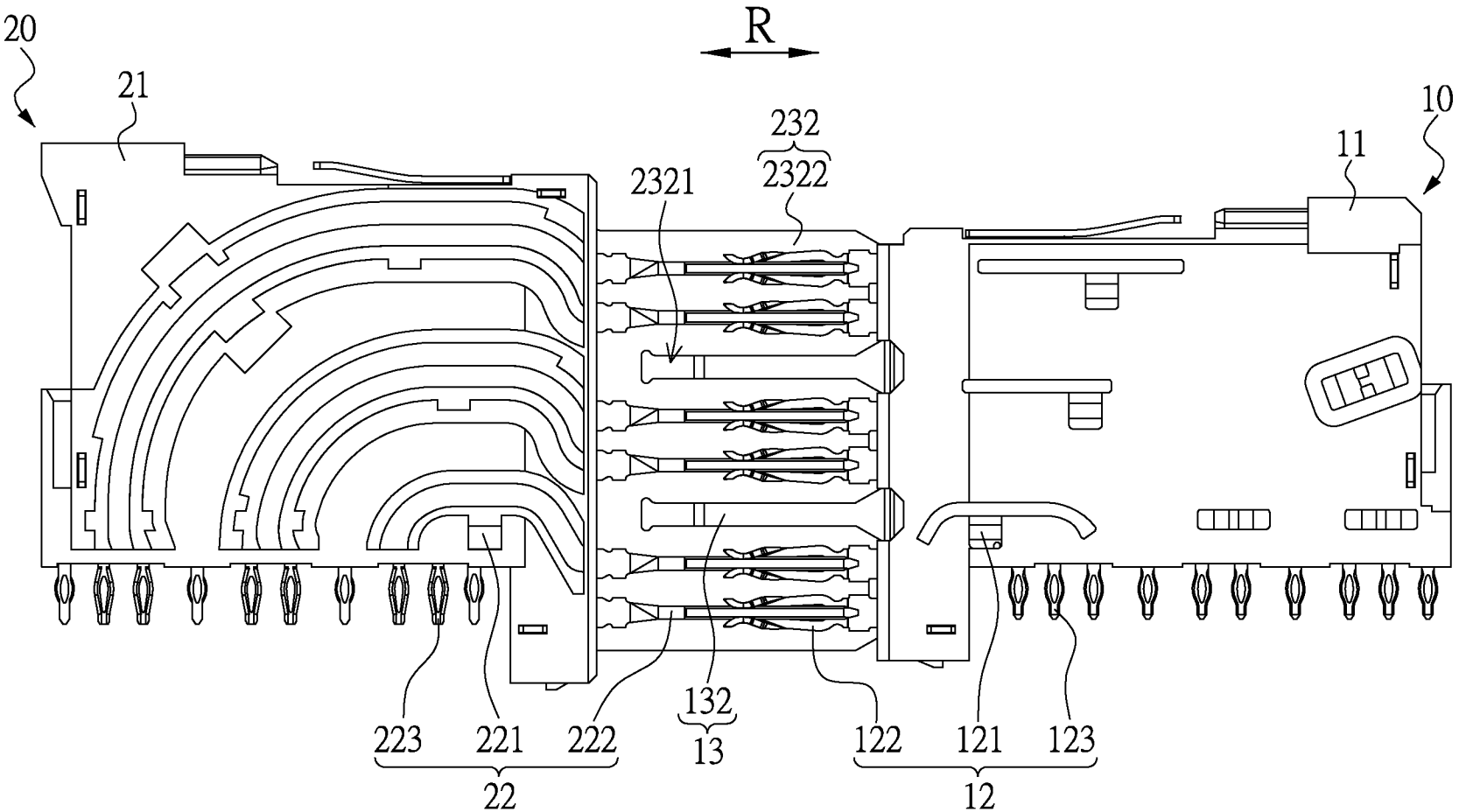
FIG. 12 is a perspective view of FIG. 11 in another viewing angle.

When observing the pair of assembled first and second lead frames 10, 20 along the shielding direction S as shown in FIG. 12, the mating portions 122, 222 of the first and second signal terminals 12, 22 are orthogonally projecting to the second shielding sheet 232, and the connected parts of the mating portions 122, 222 of the first and second signal terminals 12, 22 are orthogonally projecting to the shielding portions 2322 of the second shielding sheet 232.

THE POSSIBLE EFFECTS OF THE INSTANT EMBODIMENT

In summary, the communication connecting device of the instant embodiment is provided with better shielding effect to the first and second signal terminals by the cooperating design of the first and second signal terminal during signal transmission (more particularly, to transmission of high frequency signal).

In other words, when the first communication connector is inserted into the second communication connector, the first shielding sheet, the elastic arms, and the shielding portions entirely shield one side of the mating portions of the first and second signal terminals, thereby reducing the signal transmission of the first and second signal terminals from interference.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A communication connecting device, comprising:

a first communication connector having a plurality of first lead frames stacked in one row, and each first lead frame comprising:

a first insulating frame;

a plurality of first signal terminals installed on the first insulating frame, wherein the first signal terminals are defined as a plurality of first differential pairs, and two opposite ends of each first signal terminal protruding out of the first insulating frame are respectively defined as a mating portion and a positioning portion; and a first grounding terminal disposed on the first insulating frame, the first grounding terminal having a first shielding sheet and a plurality of groups of elastic arms integrally extended from the first shielding sheet, and the first shielding sheet and the elastic arms protruding out of the first insulating frame, wherein a contour of the first shielding sheet has an top edge, a bottom edge, and an end edge connecting the top and bottom edges, and wherein the first shielding sheet has a plurality of groups of notches arranged inside the contour thereof, and the elastic arms are respectively extended toward the notches; and a second communication connector having a plurality of second lead frames stacked in one row, and each second lead frame comprising:

a second insulating frame;

a plurality of second signal terminals installed on the second insulating frame, wherein the second signal terminals are defined as a plurality of second differential pairs, and two opposite ends of each second signal terminal protruding out of the second insulating frame are respectively defined as a mating portion and a positioning portion; and a second grounding terminal disposed on the second insulating frame and having a second shielding sheet, the second shielding sheet protruding out of the second insulating frame and having a plurality of shielding portions, wherein the first communication connector is detachably coupled to the second communication connector along an inserting direction, and the first lead frames are respectively coupled to the second lead frames, wherein at each pair of coupled first and second lead frames, the first signal terminals respectively contact the second signal terminals, and the groups of elastic arms respectively contact the shielding portions in a shielding direction perpendicular to the inserting direction, and wherein one side of the contact portions of the coupled first and second signal terminals is shielded by the first shielding sheet, the elastic arms, and the shielding portions, and an area arranged between the top and bottom edges of the first shielding sheet extends along the shielding direction to define a covering space, the shielding direction passes through at least one of the first shielding sheet, the elastic arms, and the shielding portions in the covering space, and wherein the mating portions of the first lead frames are respectively coupled to the mating portions of the second lead frames, at each pair of coupled first and second lead frames, one side of the mating portion of each first signal terminal and the mating portion of each second signal terminal is shielded by the first shielding sheet, the elastic arms, and the shielding portions.

2. The communication connecting device according to claim 1, wherein the first communication connector further comprises a first outer casing sleeved at the first lead frames, the first shielding sheet and the elastic arms of each first grounding terminal are received in the first outer casing; the second communication connector further comprises a second outer casing sleeved at the second lead frames, each second grounding terminal only exposes the shielding portions thereof to the second outer casing; and wherein the first outer casing is detachably coupled to the second outer casing along the inserting direction.

3. The communication connecting device according to claim 2, wherein at each first lead frame, the end edge of the first shielding sheet is a continuous straight; and wherein at each second lead frame, the second shielding sheet has a plurality of separating troughs concaving from an end edge thereof away from the second insulating frame toward the second insulating frame, the shielding portions are separated with each other by the separating troughs, and a portion of each separating trough adjacent to the second insulating frame is embedded in the second outer casing.

4. The communication connecting device according to claim 1, wherein at each pair of coupled first and second lead frames, the first shielding sheet is parallel to the corresponding second shielding sheet, and the first and second shielding sheets are respectively perpendicular to the shielding direction.

5. The communication connecting device according to claim 1, wherein at each first lead frame, the first grounding terminal has a first main body and a plurality of first pins, the first shielding sheet and the first pins are respectively and integrally extended from the first main body, the extending direction of the first shielding sheet is substantially perpendicular to the extending direction of each first pin, and a surface of the first grounding terminal away from the corresponding first signal terminals is exposed from the first insulating frame; at each second lead frame, the second grounding terminal has a second main body and a plurality of second pins, the second shielding sheet and the second pins are respectively and integrally extended from the second main body, the extending direction of the second shielding sheet is substantially perpendicular to the extending direction of each second pin, and a surface of the second grounding terminal away from the corresponding second signal terminals is exposed from the second insulating frame.

6. A lead frame assembly of a communication connecting device, comprising:

a first lead frame comprising:

a first insulating frame;

a plurality of first signal terminals installed on the first insulating frame, wherein the first signal terminals are defined as a plurality of first differential pairs, and two opposite ends of each first signal terminal protruding out of the first insulating frame are respectively defined as a mating portion and a positioning portion; and a first grounding terminal disposed on the first insulating frame, the first grounding terminal having a first shielding sheet and a plurality of groups of elastic arms integrally extended from the first shielding sheet, and the first shielding sheet and the elastic arms protruding out of the first insulating frame, wherein a contour of the first shielding sheet has an top edge, a bottom edge, and an end edge connecting the top and bottom edges, and wherein the first shielding sheet has a plurality of groups of notches arranged inside the contour thereof, and the elastic arms are respectively extended toward the notches; and a second lead frame comprising:

a second insulating frame;

a plurality of second signal terminals installed on the second insulating frame, wherein the second signal terminals are defined as a plurality of second differential pairs, and two opposite ends of each second signal terminal protruding out of the second insulating frame are respectively defined as a mating portion and a positioning portion; and a second grounding terminal disposed on the second insulating frame and having a second shielding sheet, the second shielding sheet protruding out of the second insulating frame and having a plurality of shielding portions, wherein the first lead frame is detachably coupled to the second lead frame along an inserting direction, the first signal terminals respectively contact the second signal terminals, and the groups of elastic arms respectively contact the shielding portions in a shielding direction perpendicular to the inserting direction, and wherein one side of the contact portions of the coupled first and second signal terminals is shielded by the first shielding sheet, the elastic arms, and the shielding portions, and an area arranged between the top and bottom edges of the first shielding sheet extends along the shielding direction to define a covering space, the shielding direction passes through at least one of the first shielding sheet, the elastic arms, and the shielding portions in the covering space, and wherein the mating portions of the first lead frame are respectively coupled to the mating portions of the second lead frame, one side of the mating portion of each first signal terminal and the mating portion of each second signal terminal is shielded by the first shielding sheet, the elastic arms, and the shielding portions.

7. The lead frame assembly according to claim 6, wherein the end edge of the first shielding sheet is a continuous straight; the first shielding sheet is parallel to the second shielding sheet, and the first and second shielding sheets are respectively perpendicular to the shielding direction.

8. The lead frame assembly according to claim 6, wherein the first grounding terminal has a first main body and a plurality of first pins, the first shielding sheet and the first pins are respectively and integrally extended from the first main body, the extending direction of the first shielding sheet is substantially perpendicular to the extending direction of each first pin, and a surface of the first grounding terminal away from the corresponding first signal terminals is exposed from the first insulating frame; the second grounding terminal has a second main body and a plurality of second pins, the second shielding sheet and the second pins are respectively and integrally extended from the second main body, the extending direction of the second shielding sheet is substantially perpendicular to the extending direction of each second pin, and a surface of the second grounding terminal away from the corresponding second signal terminals is exposed from the second insulating frame.

9. A lead frame assembly of a communication connecting device, comprising:

a first lead frame comprising:

a first insulating frame;

a plurality of first signal terminals installed on the first insulating frame; and a first grounding terminal disposed on the first insulating frame, the first grounding terminal having a first shielding sheet and a plurality of groups of elastic arms integrally extended from the first shielding sheet, and the first shielding sheet and the elastic arms protruding out of the first insulating frame, wherein the first grounding terminal has a first main body and a plurality of first pins, the first shielding sheet and the first pins are respectively and integrally extended from the first main body, the extending direction of the first shielding sheet is substantially perpendicular to the extending direction of each first pin, and a surface of the first grounding terminal away from the corresponding first signal terminals is exposed from the first insulating frame, wherein a contour of the first shielding sheet has an top edge, a bottom edge, and an end edge connecting the top and bottom edges, and wherein the first shielding sheet has a plurality of groups of notches arranged inside the contour thereof, and the elastic arms are respectively extended toward the notches; and a second lead frame comprising:

a second insulating frame;

a plurality of second signal terminals installed on the second insulating frame; and a second grounding terminal disposed on the second insulating frame and having a second shielding sheet, the second shielding sheet protruding out of the second insulating frame and having a plurality of shielding portions, wherein the second grounding terminal has a second main body and a plurality of second pins, the second shielding sheet and the second pins are respectively and integrally extended from the second main body, the extending direction of the second shielding sheet is substantially perpendicular to the extending direction of each second pin, and a surface of the second grounding terminal away from the corresponding second signal terminals is exposed from the second insulating frame, wherein the first lead frame is detachably coupled to the second lead frame along an inserting direction, the first signal terminals respectively contact the second signal terminals, and the groups of elastic arms respectively contact the shielding portions in a shielding direction perpendicular to the inserting direction, and wherein one side of the contact portions of the coupled first and second signal terminals is shielded by the first shielding sheet, the elastic arms, and the shielding portions, and an area arranged between the top and bottom edges of the first shielding sheet extends along the shielding direction to define a covering space, the shielding direction passes through at least one of the first shielding sheet, the elastic arms, and the shielding portions in the covering space.

* * * * *